United States Patent [19]

Earle

[11] 4,298,351

[45] Nov. 3, 1981

[54] METHANOL AUTOMOTIVE FUEL

[75] Inventor: Roland D. Earle, Key Largo, Fla.

[73] Assignee: Prime Manufacturing Company, Lynn, Mass.

[21] Appl. No.: 146,752

[22] Filed: May 5, 1980

[51] Int. Cl.[3] ..... C10L 1/18

[52] U.S. Cl. ..... 44/53; 44/56; 44/77

[58] Field of Search ..... 44/52, 53, 56, 77

[56] References Cited

U.S. PATENT DOCUMENTS

| | | | |
|---|---|---|---|
| 1,766,501 | 6/1930 | Buerk | 44/53 |
| 4,045,188 | 8/1977 | Hirschey | 44/56 |
| 4,104,036 | 8/1978 | Chao et al. | 44/56 |

*Primary Examiner*—Jacqueline V. Howard

*Attorney, Agent, or Firm*—Kenway & Jenney

[57] ABSTRACT

A composition for use as a gasoline substitute. The composition includes mehanol and an alkyl peroxide.

24 Claims, No Drawings

METHANOL AUTOMOTIVE FUEL

BACKGROUND OF THE INVENTION

With the world's supply of petroleum diminishing, much emphasis has been placed on finding substitutes for fuels such as gasoline which are derived from petroleum. For example, a combination of gasoline and ethyl alcohol sometimes called "gasohol" has been widely heralded because it lowers the amount of gasoline required to run an internal combustion engine. Of course, gasohol contains a large amount of gasoline (90%). It would, of course, be desirable to find a substitute for gasoline which does not employ any petroleum derivatives at all. The use of straight ethanol as an engine fuel has been explored. This approach, however, suffers from a number of deficiencies, one of which is that the principal source of ethanol is grain which would otherwise be directed to food products.

It would, of course, be highly desirable to utilize coal as a fuel for powering automobiles and other vehicles. One method suggested for utilizing coal as a fuel for internal combustion engines involves converting the coal to methanol. A suggested use for methanol is to add it to gasoline to make a fuel similar to gasohol. As an additive or extender for gasoline, methanol could fulfill a function similar to that of ethanol; but, adding methanol to gasoline presents problems. If even a small quantity of water gets into an automobile tank, a methanol-gasoline blend will separate. The methanol and water fall to the bottom of the tank, get into the engine and stall it.

The use of straight methanol as a fuel has been suggested. With minor modifications to the engine, such as raising the engine's compression ratio and adding a heating system for cold starts, an automobile can run on straight methanol. However, methanol produces only about half the calories per gallon as conventional gasoline. In connection with the foregoing, the heat of combustion figures for gasoline and methanol appear below:

Gasoline: 10.5 kilocalories per gram

Methanol: 4.7 kilocalories per gram

The significance of the foregoing is that studies anticipate that the price at the plant gate for converting coal to methanol is about 55–65% of the retail price of gasoline. Thus, unless the combustion characteristics of methanol is somehow improved, it would not be competitive with gasoline as it is presently priced. It would, of course, be highly desirable to increase the combustion characteristics of methanol so that it would be economical to use methanol as a substitute for gasoline. Of course, it should also be noted that in addition to producing methanol synthetically from coal, it can also be produced from forest and farm wastes such as wood chips, garbage, plant stocks and manure.

SUMMARY OF THE INVENTION

In accordance with the present invention, the properties of methanol as a fuel for an internal combustion engine are greatly improved by an additive which is an alkyl peroxide. Accordingly, an object of the present invention is to provide a methanol based fuel which can be utilized as a substitute in whole or in part for gasoline as a fuel for an internal combustion engine.

DESCRIPTION OF THE PREFERRED EMBODIMENTS

At the outset, the present invention is described in its broadest overall aspects with a more detailed description following. In its broadest overall aspect, the present invention is a fuel composition for an internal combustion engine. It includes methanol and an additive. The fuel composition may be utilized directly as a fuel for a typical gasoline engine or it may be mixed with gasoline in any proportion for use in such engines.

The additive itself is an alkyl peroxide. The preferred alkyl peroxide is a ditertiary alkyl peroxide of the general formula:

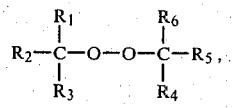

where $R_1$ through $R_6$ are lower alkyl radicals.

The most preferred additive is di-t-butyl peroxide of the formula:

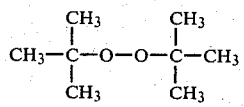

Tertiary alkyl hydroperoxides having the following formula may also be used:

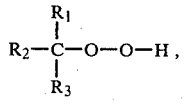

where $R_1$ to $R_3$ are lower alkyl radicals.

The preferred alkyl hydroperoxide is t-butyl hydroperoxide of the formula:

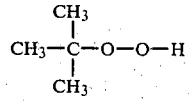

In accordance with the present invention, it has been discovered that an appropriate mixture of peroxides and methanol produces a fuel composition which burns with approximately double the efficiency of straight methanol giving approximately the same miles per gallon as gasoline. However, this fuel composition has combustion characteristics which can produce auto-ignition and accompanying knocking in a conventional gasoline engine. This problem, of course, can be overcome by engine design. However, to overcome this problem with existing engines, it has been discovered that a quantity of water and isopropanol when added to the fuel composition results in a fuel that can be substituted for conventional petroleum fuels or mixed with them as an extender without producing auto-ignition or knocking. Furthermore, the isopropanol reduces problems associated with water-methanol mixtures.

Thus, the fuel composition of the present invention is a mixture of methanol and a peroxide, but may contain additives to improve the overall characteristics and performance of the fuel.

The use of peroxides as additives for fuel has been suggested. For example, U.S. Pat. No. 1,766,501 to Buerk entitled "Liquid Combustible" discloses adding peroxides in general to improve the combustion effect of gasoline.

U.S. Pat. No. 3,108,864 to Barusch entitled "Engine Starting Fluid" describes the mixture of large quantities of dimethyl peroxide with diethyl ether as a starting primer for gasoline engines under sub-freezing conditions.

U.S. Pat. Nos. 2,011,297 to Moser entitled "Process for Preparing Motor Fuel"; 2,092,322 to Moser entitled "Process for the Production of Organic Peroxides"; 2,093,008 to Egerton entitled "Fuel for Internal Combustion Engines"; 2,107,059 to Moser entitled "Motor Fuel Composition"; 2,174,680 to Badertscher et al. entitled "Diesel Fuel"; 2,240,145 to Moser entitled "Motor Fuel Composition" and 2,891,851 to Bailey et al. entitled "Fuel for Internal Combustion Engines" disclose the use of peroxides as additives to diesel fuels.

U.S. Pat. No. 2,696,806 to Mingle, Jr. entitled "Removal of Combustion Chamber Deposits in Spark-Ignition Engines" discloses adding a peroxide to a fuel for removing deposits in spark-ignition engines.

U.S. Pat. No. 3,869,262 to Mayerhoffer et al. entitled "Fuel and Additive for the Production Thereof" is illustrative of a large number of patents disclosing the use of isopropanol in gasoline.

In accordance with the present invention, the fuel composition preferably contains 7–25% peroxide and 75–93% methanol. As used throughout this specification and claims, all percentages are by volume at room temperature unless otherwise specified. To this composition, other additives may be added. The composition may be used straight or mixed with gasoline in any proportion.

In accordance with the present invention, the following tests were run using a 1973 Lincoln Continental. The series of experiments indicated that a proper mixture of a peroxide with methanol, plus a minor adjustment in the carburetor, eliminates the problems of methanol-gasoline mixtures.

1. Mileage

A di-tertiary alkyl peroxide (specifically di-tertiary butyl peroxide) and methanol was blended. A mixture of 10% peroxide and 90% methanol was quite efficient but it was found that a 15%–85% mixture was a more optimum ratio. The viscosity of this mixture, being higher than gasoline, necessitated a change in the size of the Lincoln carburetor jets from 61 thousandths to 69 thousandths. With this size jet the peroxide mixture flows freely through the carburetor. This was the only modification made on the Lincoln for all experiments.

Aug. 12, 1979—Drove the Lincoln 120.8 miles using 10.3 gallons of regular 89 octane gasoline, giving a mileage of 11.73 miles per gallon.

Aug. 30, 1979—Drove 104.5 miles using 9 gallons of a 50—50 blend of methanol 85-peroxide 15 with regular 89 octane gasoline, giving a mileage of 11.61 miles per gallon.

Both tests were run under similar conditions indicating that the mixture had approximately the same mileage as gasoline.

2. Separation of the Mixture with Water

Sept. 21, 1979—Added 3 oz. of water to 1 gallon of a 50—50 blend of methanol 85, peroxide 15 with 93 octane no lead gasoline. The water separated the mixture into 2 layers. Unexpectedly the peroxide, although more soluble in gasoline, stayed with the methanol and water. The mixture, in its separated form, was then added to the test tank installed in the Lincoln. The Lincoln, taken out on the road, ran perfectly with the separated mixture. The Lincoln also ran perfectly with a mixture of methanol and peroxide with water, but no gasoline.

3. Cold Start

The addition of di-tertiary butyl peroxide to methanol starts a cold motor more easily than does straight methanol. This test is merely indicative and not conclusive since it was done in warm Florida weather.

4. Emissions

The emissions from the Lincoln were tested Sept. 21, 1979 with the following results:

(Present Government Specifications, at idling speed:
less than 400 P.P.M. Hydrocarbons
less than 2% Carbon Monoxide)

Methanol Peroxide 85–15 mixture:
60 P.R.M. Hydrocarbons
0.1% Carbon Monoxide

Compare: Texaco no lead 87 octane gas:
250 P.P.M. Hydrocarbons
10% Carbon Monoxide Amoco no lead hi-test 93 octane gas:
180 P.P.M. Hydrocarbons
7% Carbon Monoxide 50/50 mixture of Amoco no lead hi-test 93 octane gas with 85–15 Methanol-Peroxide mixture:
100 P.P.M. Hydrocarbons
2.6% Carbon Monoxide Many tests were run with the Lincoln. There was no noticeable difference with gaskets or hoses.

Although the di-tertiary alkyl peroxides are among the most stable of all the commercially available organic peroxides, the stability of a methanol-peroxide mixture over a long period of time was a concern. One gallon of methanol 85-ditertiary butyl peroxide 15 mixture was blended in a tin can on May 17, 1977, and stored until Sept. 22, 1979. In the test tank on the Lincoln, it gave approximately identical mileage as the same quantity of newly blended mixture. On the same day, Sept. 22, 1979, the same quantity of straight methanol yielded ½ the mileage of above old and new mixtures.

The invention is further illustrated by the following non-limiting examples.

EXPERIMENTS 18(B) AND 18(C)

Here is demonstrated the fact that by admixture of di-t-butyl peroxide and methanol (ratio 15/85 by volume), mileage is increased by 61% over that of burning methanol alone (5.96 mpg versus 9.60 mpg)

EXPERIMENTS 16 AND 18(H)

The data in these two experiments would suggest that gasoline diluted 50% with a 45/5 mixture of methanol and DTBP will give about 91% of the mileage produced by gasoline alone.

EXPERIMENTS 17(B) AND 18(C)

The data suggest the possibility that something of the order of an 80/20 or 75/25 mix of methanol/DTBP might give better mileage than an 85/15 mixture.

| EXPT | Formula | Methanol | DTBP | Gasoline | Miles | Time | Mi/Gal | MPM Speed | Remarks |
|---|---|---|---|---|---|---|---|---|---|
| 16 | 17A | 45 | 5 | 50 | 2.50 | 5.67′ | 10.00 | 35 | Fine Carb Jet 61ths |
| 17(B) | 17A | 90 | 10 | — | 2.05 | 3.78′ | 8.20 | 35 | Coarse Carb Jet 69ths |
| 18(B) | — | 100 | — | — | 1.49 | 2.72′ | 5.96 | 35 | Coarse Carb Jet 69ths |
| (C) | 18A | 85 | 15 | — | 2.40 | 4.48′ | 9.60 | 35 | Coarse Carb Jet 69ths |
| (D) | — | — | — | 100 | 2.85 | 5.40′ | 11.40 | 35 | Coarse Carb Jet 69ths |

In addition to the foregoing tests which were performed on an actual automobile, earlier tests were performed on a small motor. The details of these tests appear below:

MOTOR: Kohler, Model K91, cast iron, air-cooled, 4 cycles, Bore 2⅜″, Stroke 2″, Displacement 8.86 cu. in., Spark plug gap setting 0.025 in., breaker point gap 0.020 in., Horse power rating 4 HP.

Engine equipped with hand brake (with crude spring balance guage). Throttle setting at approximately 4,000 rpm with no load. Attempted to run all mixtures as near 2,500 rpm as possible using hand brake to slow motor.

Experiment #1:

Ran 5 oz. Texaco no lead gasoline, reported to be approximately 91 octane. Speed 2,500 rpm, Brake pressure 3 lbs., Time 12⅓ minutes.

Experiment #2:

Ran mixture 4½ oz. methanol and ½ oz. ditertiary butyl peroxide. Speed 2,700 rpm, Brake 3 lbs., Time 14 minutes.

Experiment #3:

Ran 4¼ oz. methanol and ¾ oz. di-tertiary butyl peroxide. Speed 2,700 rpm, Brake 3 lbs., Time 15¼ minutes.

Experiment #4:

Ran 4½ oz. methanol and ½ oz. Cumene hydroperoxide. Speed 2,700 rpm, Brake 3 lbs., Time 17¾ minutes. (Objectionable sweet odor from exhaust)

Experiment #5:

Ran 4¾ oz. of #2 mixture and ¼ oz. water. Speed 2,000 rpm, Brake 3 lbs., Time 18¾ minutes. (had to run leaner mixture with throttle adjustment)

Experiment #6:

Ran 5 oz. methanol with throttle adjustment of #5. Speed 2,600 rpm, Brake 3 lbs., Time 10¾ minutes.

The following experiments were run at higher speed with throttle open more and brake used to bring speed to approximately 3,200 rpm.

Experiment #10:

Ran 4½ oz. 190 proof grain alcohol and ½ oz. di-tertiary butyl peroxide. Speed 3,200 rpm, Brake 3½ lbs., Time 7½ minutes.

Experiment #12:

Ran 5 oz. Texaco no lead gas. Speed 3,200 rpm, Brake 9 lbs., Time 6 minutes. (Blue smoke emission visible.)

Experiment #13:

Ran 5 oz. methanol, open throttle to almost maximum to obtain nearly same speed with greater brake pressure. Speed 3,000 rpm, Brake 7½ lbs., Time 5 minutes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A fuel for use in an internal combustion engine comprising methanol containing 7–25% of a tertiary alkyl peroxide.

2. The fuel as set forth in claim 1 wherein said tertiary alkyl peroxide is a ditertiary alkyl peroxide.

3. The fuel as set forth in claim 2 wherein the ditertiary alkyl peroxide is ditertiary butyl peroxide.

4. The fuel as set forth in claim 3 wherein the composition of the fuel is about 15% ditertiary butyl peroxide and 85% methanol.

5. The fuel as set forth in claim 1 also including additives to reduce problems associated with water-methanol mixtures, auto-ignition and knocking.

6. The fuel as set forth in claim 2 also including additives to reduce problems associated with water-methanol mixtures, auto-ignition and knocking.

7. The fuel as set forth in claim 3 also including additives to reduce problems associated with water-methanol mixtures, auto-ignition and knocking.

8. The fuel as set forth in claim 4 also including additives to reduce problems associated with water-methanol mixtures, auto-ignition and knocking.

9. The fuel as set forth in claim 5 wherein the additive includes isopropanol.

10. The fuel as set forth in claim 6 wherein the additive includes isopropanol.

11. The fuel as set forth in claim 7 wherein the additive includes isopropanol.

12. The fuel as set forth in claim 8 wherein the additive includes isopropanol.

13. A fuel for use in an internal combustion engine comprising gasoline and an additive comprising methanol containing 7–25% of a tertiary alkyl peroxide.

14. The fuel as set forth in claim 13 wherein said tertiary alkyl peroxide is a ditertiary alkyl peroxide.

15. The fuel as set forth in claim 14 wherein the ditertiary alkyl peroxide is ditertiary butyl peroxide.

16. The fuel as set forth in claim 15 wherein the composition of the fuel is about 15% ditertiary butyl peroxide and 85% methanol mixed with gasoline in any proportion.

17. The fuel as set forth in claim 13 also including further additives to reduce problems associated with water-gasoline mixtures, auto-ignition and knocking.

18. The fuel as set forth in claim 14 also including further additives to reduce problems associated with water-gasoline mixtures, auto-ignition and knocking.

19. The fuel as set forth in claim 15 also including further additives to reduce problems associated with water-gasoline mixtures, auto-ignition and knocking.

20. The fuel as set forth in claim 16 also including further additives to reduce problems associated with water-gasoline mixtures, auto-ignition and knocking.

21. The fuel as set forth in claim 17 wherein the further additive includes isopropanol.

22. The fuel as set forth in claim 18 wherein the further additive includes isopropanol.

23. The fuel as set forth in claim 19 wherein the further additive includes isopropanol.

24. The fuel as set forth in claim 20 wherein the further additive includes isopropanol.

* * * * *